United States Patent [19]

Wehde

[11] 4,158,284

[45] Jun. 19, 1979

[54] YARN QUALITY MONITORING APPARATUS

[75] Inventor: Heinz Wehde, Rothenberg, Fed. Rep. of Germany

[73] Assignee: Teldix GmbH, Heidelberg, Fed. Rep. of Germany

[21] Appl. No.: 863,156

[22] Filed: Dec. 22, 1977

[30] Foreign Application Priority Data

Dec. 23, 1976 [DE] Fed. Rep. of Germany ..... 2658477

[51] Int. Cl.[2] ..... D01H 1/12; D01H 13/14; D01H 13/22

[52] U.S. Cl. ..... 57/265; 57/58.89; 57/81; 57/264

[58] Field of Search ..... 57/34 R, 58.89–58.95, 57/93, 100, 81, 264, 265

[56] References Cited

U.S. PATENT DOCUMENTS

| | | | |
|---|---|---|---|
| 3,316,699 | 5/1967 | Mattingly | 57/93 |
| 3,662,531 | 5/1972 | Carroll | 57/93 X |
| 3,665,306 | 5/1972 | Orth | 57/93 X |
| 3,877,210 | 4/1975 | Seidl | 57/265 |
| 3,879,926 | 4/1975 | Bartling et al. | 57/34 R X |
| 3,972,171 | 8/1976 | Handschuch et al. | 57/100 X |
| 4,016,713 | 4/1977 | Lauger et al. | 57/100 |
| 4,019,310 | 4/1977 | Seidl et al. | 57/265 |

*Primary Examiner*—John Petrakes
*Attorney, Agent, or Firm*—Spencer & Kaye

[57] ABSTRACT

In order to monitor irregularities and changes in structure of yarn being produced in an open-end spinning turbine provided with its own individual drive motor, there is provided a circuit which senses and evaluates changes in the current consumption by the motor.

7 Claims, 3 Drawing Figures

YARN QUALITY MONITORING APPARATUS

BACKGROUND OF THE INVENTION

The present invention relates to an apparatus for monitoring irregularities and/or changes in the structure of a textile yarn coming from an open-end spinning turbine, the monitoring apparatus being of the type which includes a measuring value sensor to sense irregularities and an evaluation circuit which, upon the occurrence of irregularities, generates a signal to actuate an indicator and/or to switch off the spinning turbine.

Such an apparatus is disclosed in German Offenlegungsschrift [laid-open application] No. 2,509,259. In that apparatus, a sensor is provided in the yarn removal path to generate an analog signal which is representative of the thickness of the yarn. A pulse is generated each time this analog signal exceeds or drops below threshold values, i.e., when the thickness of the yarn is above or below a selected range, and the resulting pulses are counted in a counter, the occurrence of at least a given number of pulses within a given period of time causing a display or switch-off signal to be emitted.

Monitoring of the yarn being produced in an open-end spinning machine is recommended because irregularities, particularly thickness variations in the yarn may occur irregularly in cycles or even at regular intervals and thus would lead to undesirable moiré effects in fabrics produced from that yarn.

Such thicker or thinner portions are produced mainly as a result of deposits of dirt particles in the rotor of the spinning turbine, and additionally by other causes.

The yarn may also exhibit changes in its structure.

SUMMARY OF THE INVENTION

It is therefore an object of the present invention to simplify the detection of such thickness variations and/or changes in structure, at least in the type of open-end spinning turbine which has its own individual drive member.

This and other objects are achieved, according to the present invention by associating with the drive member of such a spinning turbine a sensor which responds to changes in the drive member current consumption. Various motors can be used as the drive member. When a brushless d.c. motor is used, the motor current changes are particularly distinct.

The present invention is based on the realization that certain changes in the yarn being produced in the spinning turbine will vary the mechanical load, or torque, on the motor during yarn removal and thus the current consumption of the motor. This can occur, for example, as a result of the creation of a thicker section in the yarn due to a locally limited dirt deposit in the spinning rotor fiber collection trough, or upon the occurrence of a change in yarn structure due to extensive deposits in the fiber collection trough, or as a result of wear in the fiber collection trough. The variations in current consumption are due to the changed, particularly enlarged, yarn mass per unit length, producing a change in friction, and the changed, particularly greater, air resistance exhibited by the yarn.

It is known that in the operation of an open-end spinning turbine, the binding point rotates somewhat faster than the spinning rotor itself. The binding point is that point along the fiber collection trough circumference where the fibers are bound into the yarn and the yarn ceases to contact the collection trough. The difference in rates of rotation is, for example, between 10 and 50 Hz. With a yarn removal speed of, for example, 200 m/min and a rotor circumference of about 15 cm, the binding point will rotate about 20 Hz faster than the rotor itself. A periodic thicker or thinner section in the yarn will thus produce a periodic increase or decrease, respectively, in current consumption having a frequency of about 20 Hz.

The current being supplied to the motor can be sensed by a circuit including, for example, a lowpass filter which permits signals at this frequency to pass while filtering out the much higher drive current commutation frequency. The evaluation circuit in this case will be designed to produce a warning or switching signal upon the occurrence of a given number of changes which lie above and/or below a threshold.

The evaluation circuit can also be designed to respond to a single deviation, and possibly a deviation having a certain duration, or a given magnitude in one or either direction from the desired current consumption.

Both types of change, i.e. a single and possibly long duration deviation, and a periodically varying fluctuation, can be evaluated and used simultaneously. In addition, the monitoring apparatus according to the invention can be combined with an additional monitoring apparatus whose sensor responds to radial deflections of the rotor or of its bearing, in the case of a turbine whose rotor bearing is elastically mounted and is thus subject to such radial deflections. In this case the only changes which can be sensed, however, are those produced by locally defined imbalances, e.g., deposits. The radial deflection sensor could be a displacement measuring device operating in an inductive, capacitive or other known manner, or a sensor which could be of the inductive type, responsive to the velocity of the radial deflection movement. The periodic change here occurs at the rotor rotation frequency. Here again a switching or warning signal is produced when one or a given number of changes occur during a given period of time.

DESCRIPTION OF THE PREFERRED EMBODIMENTS

Figure 1:
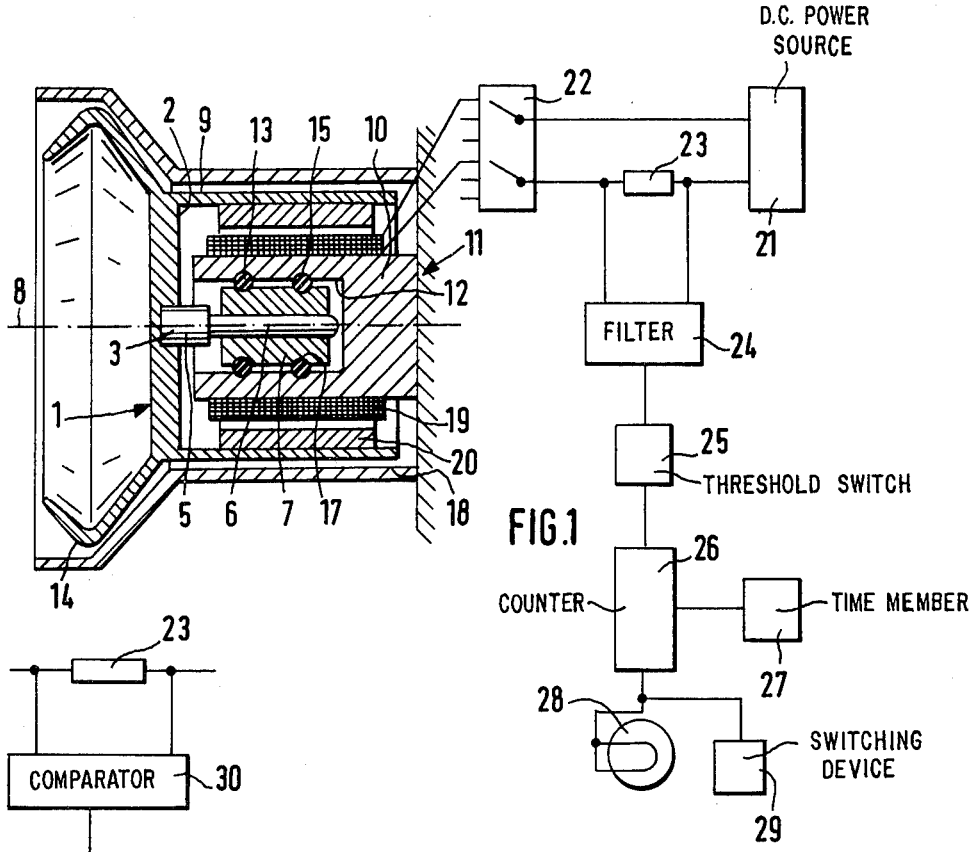
FIG. 1 is partly a cross-sectional side view of an open-end spinning turbine equipped with an individual brushless d.c. motor, and partly a schematic block circuit diagram of an associated evaluation circuit for monitoring drive current changes according to the invention.

FIG. 1 shows an open-end spinning turbine equipped with its own drive system, which is exemplary of the type of spinning turbine in which the present invention can be used.

The turbine includes a rotor 1 provided with a cup-shaped or bell-shaped part 9 which has a bore 3 at the center of its base 2. In the bore 3 a pin 5 is positioned, and the free end 6 of the pin projects into a bearing bush 7. Free end 6 and bush 7 together constitute a journal bearing, the bush being the stationary part of the bearing and end 6 being the rotary part thereof. The center of gravity of the rotor is located at least approximately on its axis of symmetry 8, and between the axial ends of the bearing bush 7. A part 10 of a stator 11 projects into the cup-shaped rotor part 9, and has a bore 12 to accommodate the bearing bush 7. The bearing bush 7 is elastically supported in the bore 12 by means of parts of elastic material which are constructed as O-rings 13. These O-rings lie in annular grooves 15 in the interior surface of the bore 12, as well as in annular grooves 17 in the outer surface of the bearing bush 7.

An electric motor is provided for driving the rotor 1. To this end substantially radially magnetized permanent magnets 20 are positioned on the inner surface of the cup-shaped part 9 of rotor 1. The permanent magnets 20 have an alternating polarity in the peripheral direction and are fastened to the rotor as individual magnets.

Windings 19 are provided on the outer face of the stator part 10 and are associated with the permanent magnets. A current is caused to flow through the windings so that the rotor is driven, for example, like a brushless direct current motor. The windings 19 are constructed without iron so as to prevent additional forces or moments from being generated which an act on the bearing and which would otherwise be present in an electric motor constructed in this way.

The front end of the rotor (to the left in FIG. 1) is constructed to have a funnel-like form 14. When using this device in spinning frames, or turbines, operating according to the open-end method, the material to be spun is introduced into the funnel-like front end of the rotor and drawn off in a known manner. If, for example, as a result of manufacturing tolerances or of the material located in the funnel 14, the center of gravity of the rotor is not located exactly on the axis of symmetry 8, the rotor can still rotate about its largest central principal axis of inertia adjacent axis 8 because of the floating bearing which is provided as above described, thereby preventing creation of additional bearing forces.

The importance of the construction of the drive motor as an iron-free electric motor is then enhanced in that it also ensures that no additional radial forces or moments are exerted on the bearing even by the drive itself, that is to say, even if the rotor does not rotate exactly about the axis 8. In order to reduce drive losses due to the air resistance, which occur particularly at high speed, the rotor is surrounded on its outside by a stationary housing 18.

Assuming that the windings 19 have the form of a three-phase winding, the three phases are connected in succession to d.c. power source 21 by means of a commutating switch 22. For reasons of simplicity only the conductor pair for one winding phase is shown connected to the switch. The commutation operation of switch 22 is well known in the art and will not be explained in detail here.

A resistor 23 is connected into the current input lead from source 21 and a voltage proportional to the supply current is derived therefrom. If the reaction torque on the motor changes due to the occurrence of a thicker or thinner yarn section the drive current amplitude changes correspondingly. The voltage across resistor 23 is supplied to a series-connected filter 24 dimensioned so that, for example, only signal frequency components $< 100$ Hz reach its output. Thus it is essentially a voltage which corresponds to the fundamental frequency of the current peaks produced by such thicker yarn sections or current dips produced by thinner yarn sections which passes through filter 24 to a threshold value switch 25 and if this voltage is of the appropriate amplitude, a pulse will reach a counter 26 connected to the output of switch 25.

Counter 26 counts, or adds, the pulses supplied thereto during each time period, the duration of which is set by a time member 27, and when a given counter state is exceeded during one of these time periods, the counter emits an output signal, for example, to switch on the warning lamp 28 or to actuate the switch 29 which switches off the drive to the turbine.

Figure 2:
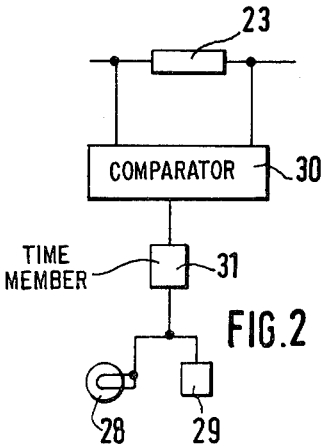
FIG. 2 is a block circuit diagram of another embodiment of an evaluation circuit according to the invention.

If, in addition, a longer duration increase and/or decrease in current magnitude are to be sensed, the voltage observed across resistor 23 is fed, in the circuit shown in FIG. 2, to a comparator 30 which compares this voltage with a desired voltage and, beginning with a given deviation from the desired voltage, emits an output signal which actuates the warning and/or switching device 28, 29, for example, only if the deviation continues for more than a given time, the duration of which is determined by a time member 31. The comparator 30 may include a memory member which derives the comparison value, i.e., the desired voltage from the previously determined actual signal, e.g., during the preceding 1 second, so that here, too, a change produces an output signal.

Figure 3:
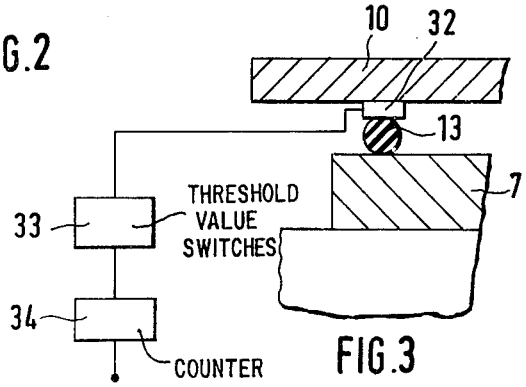
FIG. 3 is partly a cross-section detail view and partly a block circuit diagram of a sensor and an evaluation circuit for sensing imbalance signals, which circuit can be used in addition to the evaluation circuits of FIGS. 1 and 2.

In addition to monitoring the current in the manner shown in FIGS. 1 and/or 2, the radial deflections of the bearing 7 or of the rotor 1, 5 of the turbine of FIG. 1 as the result of imbalances produced by thicker yarn sections can be detected, as shown in FIG. 3, by means of a sensor 32 which operates, for example, according to the piezoelectric principle and is associated with one of the elastic O-rings 13 of the elastically mounted bearing. Sensor 32 produces pulses in response to fluctuations in pressure, which pulses are fed via threshold value switches 33 to a counter 34 which upon counting a given number of pulses within a given period of time emits an output signal to members 28 and 29, shown in FIGS. 1 and 2.

The current consumption of a turbine drive motor is dependent on several things. Changes in that current for which a warning or switch-off signal should be produced may be, for example, more than 5%. The duration of time member 31 of FIG. 2 may be 1 or several seconds. The number of changes allowed in the circuit of FIG. 1 may be less than 50. Similarly the changes allowed in FIG. 3 may also be less than 50.

It will be understood that the above description of the present invention is susceptible to various modifications, changes and adaptations, and the same are intended to be comprehended within the meaning and range of equivalents of the appended claims.

What is claimed is:

1. In apparatus for monitoring yarn being produced in an open-end spinning turbine provided with its own electric drive motor, which apparatus includes means for detecting spinning condition variations which cause irregularities and/or changes in structure in the yarn and an evaluation circuit providing an indication upon the occurrence of such irregularity, the improvement wherein said detecting means comprises a sensor connected for sensing changes in the current consumption of the drive motor indicative of the occurrence of such spinning condition variations.

2. An arrangement as defined in claim 1 wherein said motor is a brushless d.c. motor.

3. An arrangement as defined in claim 1 wherein said evaluation circuit is arranged to respond to a single such change of a given magnitude in the current consumption.

4. An arrangement as defined in claim 3 wherein said circuit responds to such changes having a predetermined minimum duration.

5. An arrangement as defined in claim 1 wherein said evaluation circuit responds to short-duration changes in motor current consumption and provides an indication when a given number of such changes occur during a given period of time.

6. An arrangement as defined in claim 1 wherein the turbine includes a rotor and an elastically mounted bearing bush supporting the rotor, and further comprising a second sensor disposed for sensing radial deflections experienced by the bush during rotation of the rotor due to imbalances, and a second evaluation circuit connected to said second sensor and operative to produce an indication upon the occurrence of such radial deflections.

7. An arrangement as defined in claim 6 wherein the evaluation circuit is operative to produce the indication upon the occurrence of a given number of radial deflections during a given time period.

* * * * *